US011223148B2

(12) United States Patent
Obata

(10) Patent No.: US 11,223,148 B2
(45) Date of Patent: Jan. 11, 2022

(54) FLOATING CONNECTOR

(71) Applicant: Japan Aviation Electronics Industry, Ltd., Tokyo (JP)

(72) Inventor: Yusuke Obata, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 16/904,977

(22) Filed: Jun. 18, 2020

(65) Prior Publication Data

US 2021/0091498 A1 Mar. 25, 2021

(30) Foreign Application Priority Data

Sep. 20, 2019 (JP) ..... JP2019-171092

(51) Int. Cl.

| | |
|---|---|
| ***H01R 13/631*** | (2006.01) |
| ***H01R 12/91*** | (2011.01) |
| ***H01R 12/71*** | (2011.01) |
| ***H01R 13/11*** | (2006.01) |

(52) U.S. Cl.
CPC ..... *H01R 12/91* (2013.01); *H01R 12/716* (2013.01); *H01R 13/113* (2013.01)

(58) Field of Classification Search
CPC .... H01R 12/91; H01R 12/716; H01R 13/113; H01R 12/712; H01R 13/6315
USPC ..... 439/248
See application file for complete search history.

(56) References Cited

U.S. PATENT DOCUMENTS

| | | | | |
|---|---|---|---|---|
| 10,199,761 | B1 * | 2/2019 | Kuo | H01R 13/405 |
| 10,535,947 | B1 * | 1/2020 | Kuo | H01R 12/57 |
| 11,031,730 | B2 * | 6/2021 | Mitter | H01R 13/08 |
| 2004/0014335 | A1 | 1/2004 | Igarashi et al. | |
| 2006/0276061 | A1 | 12/2006 | Koguchi et al. | |
| 2010/0055952 | A1 * | 3/2010 | Fukazawa | H01R 12/707 439/248 |

(Continued)

FOREIGN PATENT DOCUMENTS

| | | | |
|---|---|---|---|
| CN | 206076547 | U | 4/2017 |
| JP | 2007018785 | A | 1/2007 |
| WO | 2011017282 | A1 | 2/2011 |

OTHER PUBLICATIONS

Extended European Search Report corresponding application No. 20187426.0 dated Dec. 16, 2020.

(Continued)

*Primary Examiner* — Abdullah A Riyami
*Assistant Examiner* — Nelson R. Burgos-Guntin
(74) *Attorney, Agent, or Firm* — Renner, Otto, Boisselle & Sklar, LLP

(57) ABSTRACT

A receptacle connector includes a fixed housing, a movable housing, a plurality of receptacle contacts disposed across the fixed housing and the movable housing, and a receptacle hold-down that restricts upward movement of the movable housing from the fixed housing. The movable housing is movable in a pitch direction of the plurality of receptacle contacts in relation to the fixed housing. The receptacle hold-down includes two housing fixing parts to be fixed to the fixed housing, and an elastic deformation part supported by the housing fixing parts and opposed to the movable housing in an insertion and removal direction. The elastic deformation part is opposed to the movable housing in the pitch direction and elastically deformable in the pitch direction.

8 Claims, 16 Drawing Sheets

(56) References Cited

U.S. PATENT DOCUMENTS

| | | | | |
|---|---|---|---|---|
| 2011/0294326 | A1* | 12/2011 | Tanaka | H01R 13/6315 439/248 |
| 2015/0024620 | A1* | 1/2015 | Kobayashi | H01R 13/62 439/345 |
| 2015/0044901 | A1* | 2/2015 | Doi | H01R 13/41 439/374 |
| 2015/0044919 | A1* | 2/2015 | Kimura | H01R 12/85 439/862 |
| 2015/0132999 | A1* | 5/2015 | Sato | H01R 24/60 439/676 |
| 2015/0333446 | A1* | 11/2015 | Yuan | H01R 13/6315 439/248 |
| 2017/0179626 | A1* | 6/2017 | Hori | H01R 12/712 |
| 2018/0145467 | A1* | 5/2018 | Doi | H01R 12/73 |
| 2019/0052005 | A1* | 2/2019 | Hasegawa | H01R 13/405 |
| 2020/0083643 | A1* | 3/2020 | Hashiguchi | H01R 13/11 |
| 2020/0176930 | A1* | 6/2020 | Shioda | H01R 12/91 |
| 2020/0295511 | A1* | 9/2020 | Shioda | H01R 12/71 |
| 2021/0091498 | A1* | 3/2021 | Obata | H01R 12/716 |
| 2021/0104840 | A1* | 4/2021 | Doi | H01R 13/115 |
| 2021/0111504 | A1* | 4/2021 | Kobayashi | H01R 43/24 |

OTHER PUBLICATIONS

European Office Action corresponding application No. 20187426.0 dated Jan. 13, 2021.

* cited by examiner

FLOATING CONNECTOR

INCORPORATION BY REFERENCE

This application is based upon and claims the benefit of priority from Japanese patent application No. 2019-171092, filed on Sep. 20, 2019, the disclosure of which is incorporated herein in its entirety by reference.

BACKGROUND

The present disclosure relates to a floating connector.

Japanese Unexamined Patent Application Publication No. 2007-18785 discloses, as shown in FIG. 16 of the present application, a connector 103 in which a plurality of contacts 102 are disposed across a fixed block 100 and a movable housing 101, so that the movable housing 101 floats in the pitch direction with respect to the fixed block 100. On the fixed block 100, a fixed tab 104 that restricts the movement of the movable housing 101 in the removal direction from the fixed block 100 is mounted.

SUMMARY

In Japanese Unexamined Patent Application Publication No. 2007-18785 described above, a gap between the movable housing 101 and the fixed tab 104 in the pitch direction needs to be large enough in order to achieve a desired amount of floating of the movable housing 101 in the pitch direction. Thus, achieving a desired amount of floating and downsizing a connector in the pitch direction are in the relationship of trade-off.

In view of the foregoing, an object of the present disclosure is to provide a technique of both achieving a desired amount of floating in the pitch direction and downsizing a floating connector in the pitch direction.

According to an aspect of the present disclosure, there is provided a floating connector including a fixed housing, a movable housing, a plurality of contacts disposed across the fixed housing and the movable housing, and a movement restriction member that restricts movement of the movable housing in a removal direction from the fixed housing, wherein the movable housing is movable in a pitch direction of the plurality of contacts in relation to the fixed housing, the movement restriction member includes at least one fixed part to be fixed to the fixed housing and an elastic deformation part supported by the at least one fixed part and opposed to the movable housing in a direction parallel to the removal direction, and the elastic deformation part is opposed to the movable housing in the pitch direction and elastically deformable in the pitch direction.

According to the present disclosure, it is possible to both achieve a desired amount of floating in the pitch direction and downsize a floating connector in the pitch direction.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

A first embodiment of the present disclosure is described hereinafter with reference to FIGS. 1 to 11.

Figure 1:
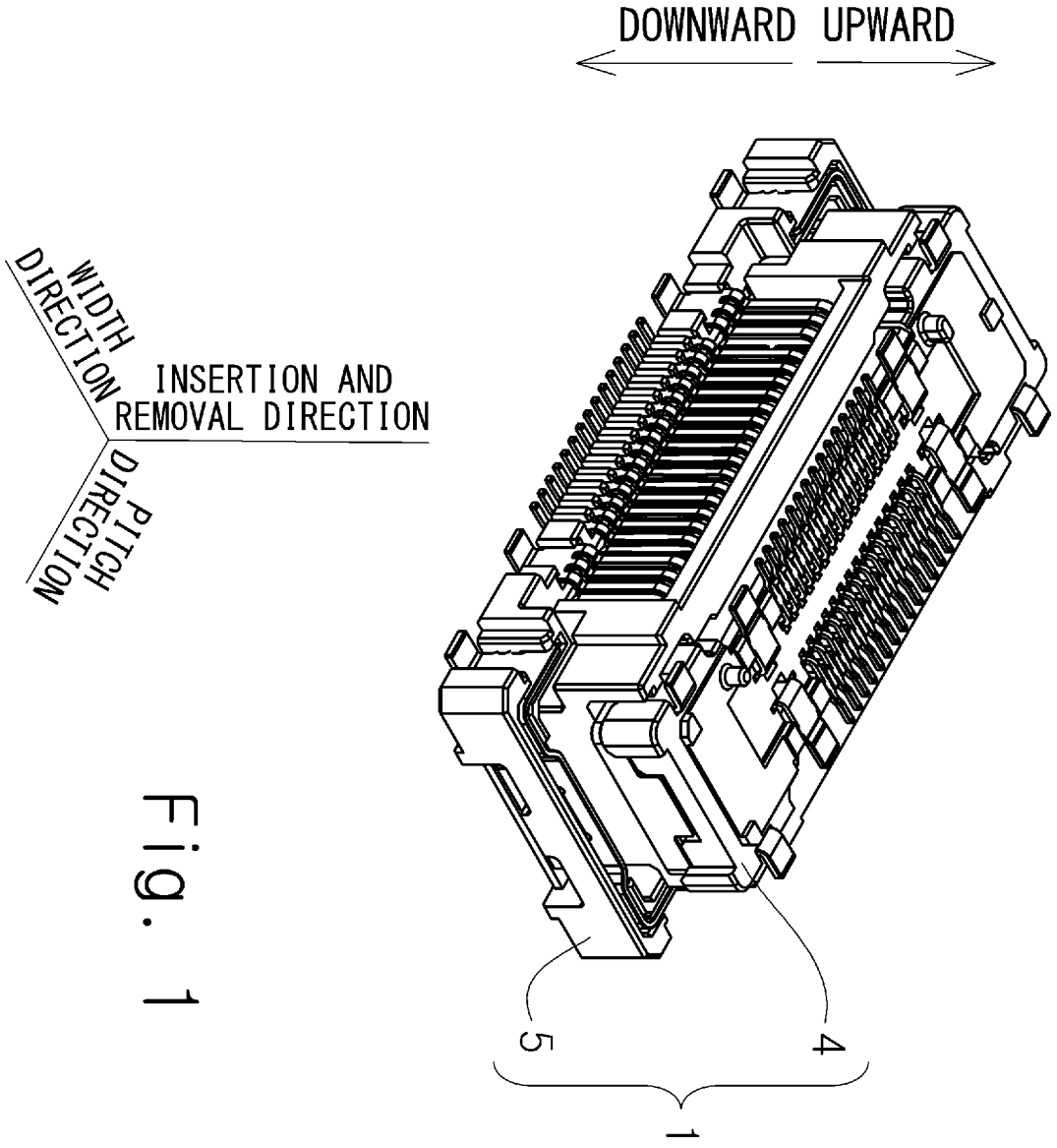
FIG. 1 is a perspective view of a connector assembly mated together.
Figure 2:
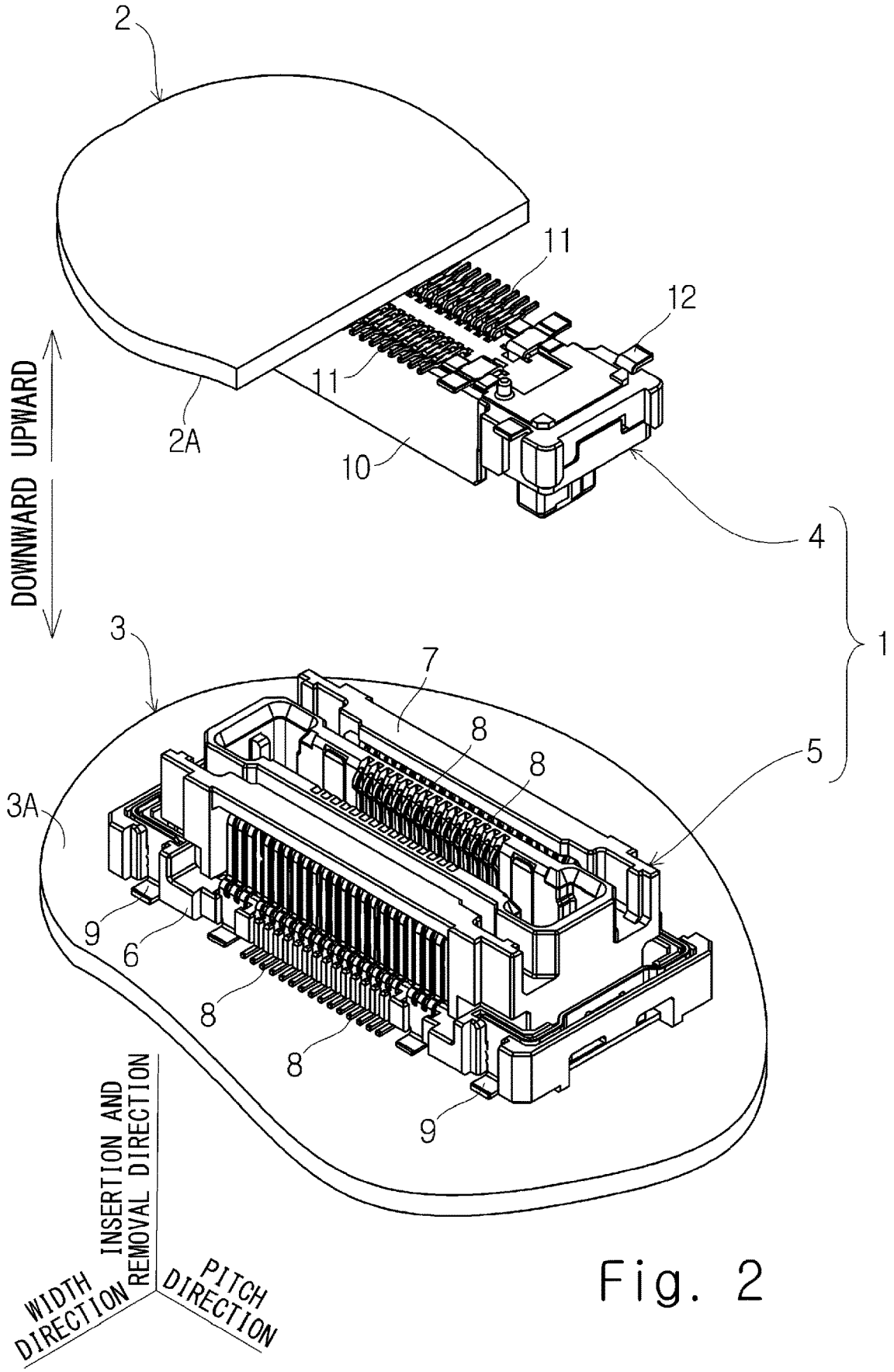
FIG. 2 is a perspective view of the connector assembly before being mated together.

As shown in FIGS. 1 and 2, a connector assembly 1 is a board-to-board connector that mechanically and electrically connects a plug board 2 and a receptacle board 3, and it includes a plug connector 4 to be mounted on a connector mounting surface 2A of the plug board 2 and a receptacle connector 5 (floating connector) to be mounted on a connector mounting surface 3A of the receptacle board 3.

Figure 3:
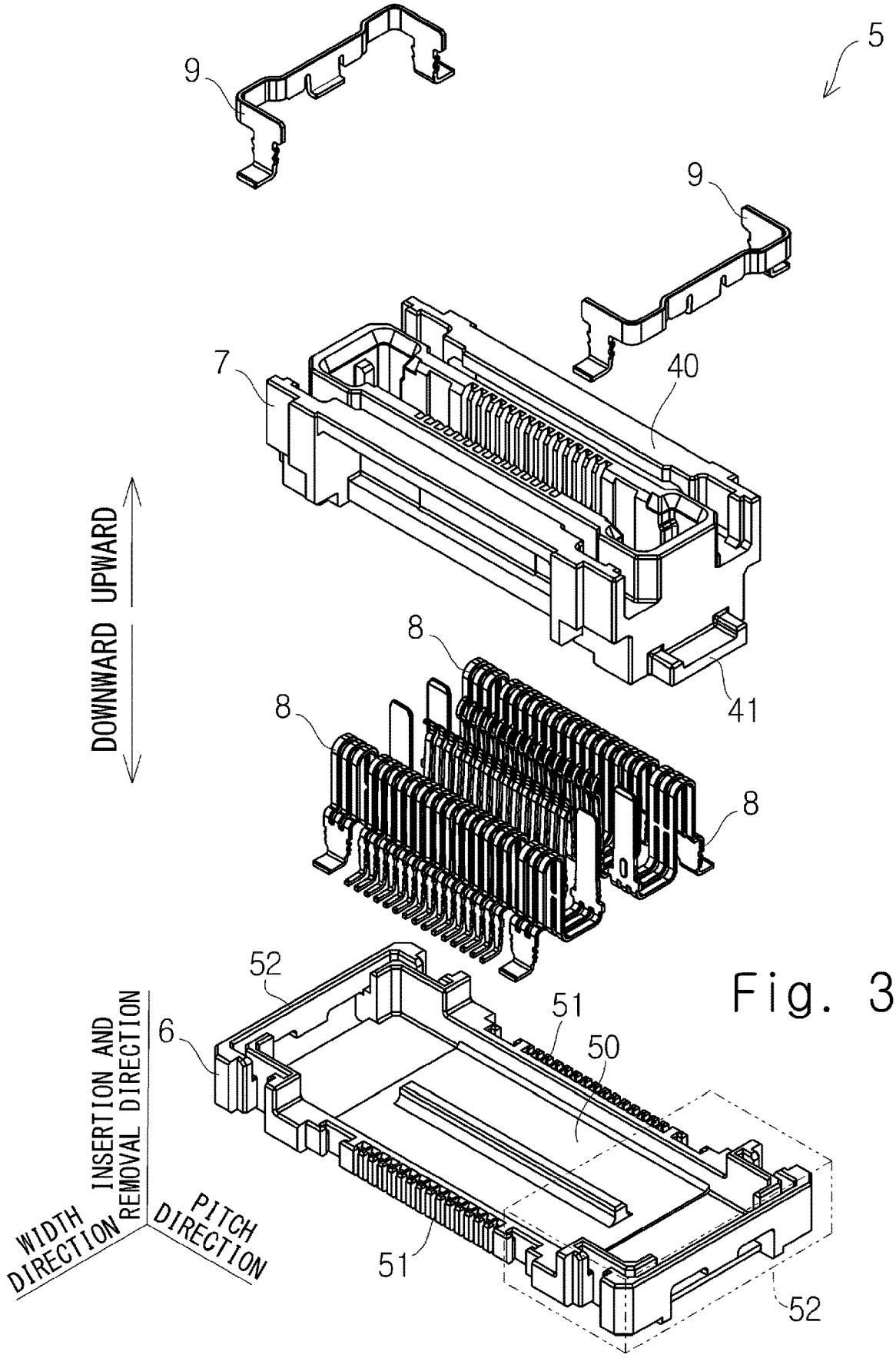
FIG. 3 is an exploded perspective view of a receptacle connector.

As shown in FIGS. 2 and 3, the receptacle connector 5 includes a fixed housing 6, a movable housing 7, a plurality of receptacle contacts 8 (contacts), and two receptacle hold-downs 9 (movement restriction member).

The fixed housing 6 and the movable housing 7 are disposed so as to overlap each other in the direction orthogonal to the connector mounting surface 3A of the receptacle board 3. The plurality of receptacle contacts 8 are disposed across the fixed housing 6 and the movable housing 7. The plurality of receptacle contacts 8 are arranged in two rows in the direction parallel to the connector mounting surface 3A of the receptacle board 3. The two receptacle hold-downs 9 fix the fixed housing 6 to the connector mounting surface 3A of the receptacle board 3.

The terms "insertion and removal direction", "pitch direction" and "width direction" are defined by referring to FIGS. 1 to 3. The insertion and removal direction, the pitch direction and the width direction are directions that are orthogonal to one another.

The insertion and removal direction is the direction in which the plug connector 4 is inserted into and removed from the receptacle connector 5. The insertion and removal direction is the direction orthogonal to the connector mounting surface 2A of the plug board 2 and the connector mounting surface 3A of the receptacle board 3. The insertion and removal direction includes upward (removal direction) and downward (mating direction). The upward direction is the direction in which the plug connector 4 is removed from the receptacle connector 5. The downward direction is the direction in which the plug connector 4 is mated with the receptacle connector 5.

The pitch direction is the direction along which the plurality of receptacle contacts 8 are aligned. In the case where the plurality of receptacle contacts 8 are arranged in two rows as in this embodiment, the pitch direction can be defined as the direction along which the plurality of receptacle contacts 8 belonging to one of the two rows are aligned. The pitch direction is the direction parallel to the connector mounting surface 2A of the plug board 2 and the connector mounting surface 3A of the receptacle board 3. The pitch direction includes inward and outward in the pitch direction. Inward in the pitch direction is the direction toward the center of the connector assembly 1 in the pitch direction. Outward in the pitch direction is the direction away from the center of the connector assembly 1 in the pitch direction.

The width direction is the direction orthogonal to the insertion and removal direction and the pitch direction. In the case where the plurality of receptacle contacts 8 are arranged in two rows as in this embodiment, the width direction can be defined as the direction along which the two rows are opposed to each other. The width direction is the direction parallel to the connector mounting surface 2A of the plug board 2 and the connector mounting surface 3A of the receptacle board 3. The width direction includes inward and outward in the width direction. Inward in the width direction is the direction toward the center of the connector assembly 1 in the width direction. Outward in the width direction is the direction away from the center of the connector assembly 1 in the width direction.

In this embodiment, the receptacle connector 5 is what is called a floating connector. Specifically, as shown in FIG. 3, each of the receptacle contacts 8 is bent into S-shape. Both ends of each of the receptacle contacts 8 are fixed to the fixed housing 6 and the movable housing 7, respectively. Each of the receptacle contacts 8 is formed by punching and bending a metal plate made of copper or copper alloy. Thus, each of the receptacle contacts 8 is elastically deformable, and therefore the movable housing 7 is able to move and tilt with respect to the fixed housing 6 in the pitch direction and the width direction. That is, the movable housing 7 is able to float with respect to the fixed housing 6. Since the receptacle connector 5 is a floating connector, even if the plug board 2 is tilted with respect to the receptacle board 3 or the plug connector 4 and the receptacle connector 5 are slightly misaligned in the pitch direction or the width direction when mating the plug connector 4 with the receptacle connector 5, it is possible to tolerate an error and mate the plug connector 4 and the receptacle connector 5 together.

Plug Connector 4

Referring back to FIG. 2, the plug connector 4 includes a plug housing 10, a plurality of plug contacts 11, and two plug hold-downs 12 (refer also to FIG. 1). The plurality of plug contacts 11 are disposed to come into contact with the plurality of receptacle contacts 8, respectively, when the plug connector 4 is mated with the receptacle connector 5. The two plug hold-downs 12 fix the plug housing 10 to the connector mounting surface 2A of the plug board 2.

Receptacle Connector 5

The receptacle connector 5 is described hereinafter in detail with reference to FIGS. 4 to 8.

Receptacle Connector 5: Receptacle Hold-Down 9

Figure 4:
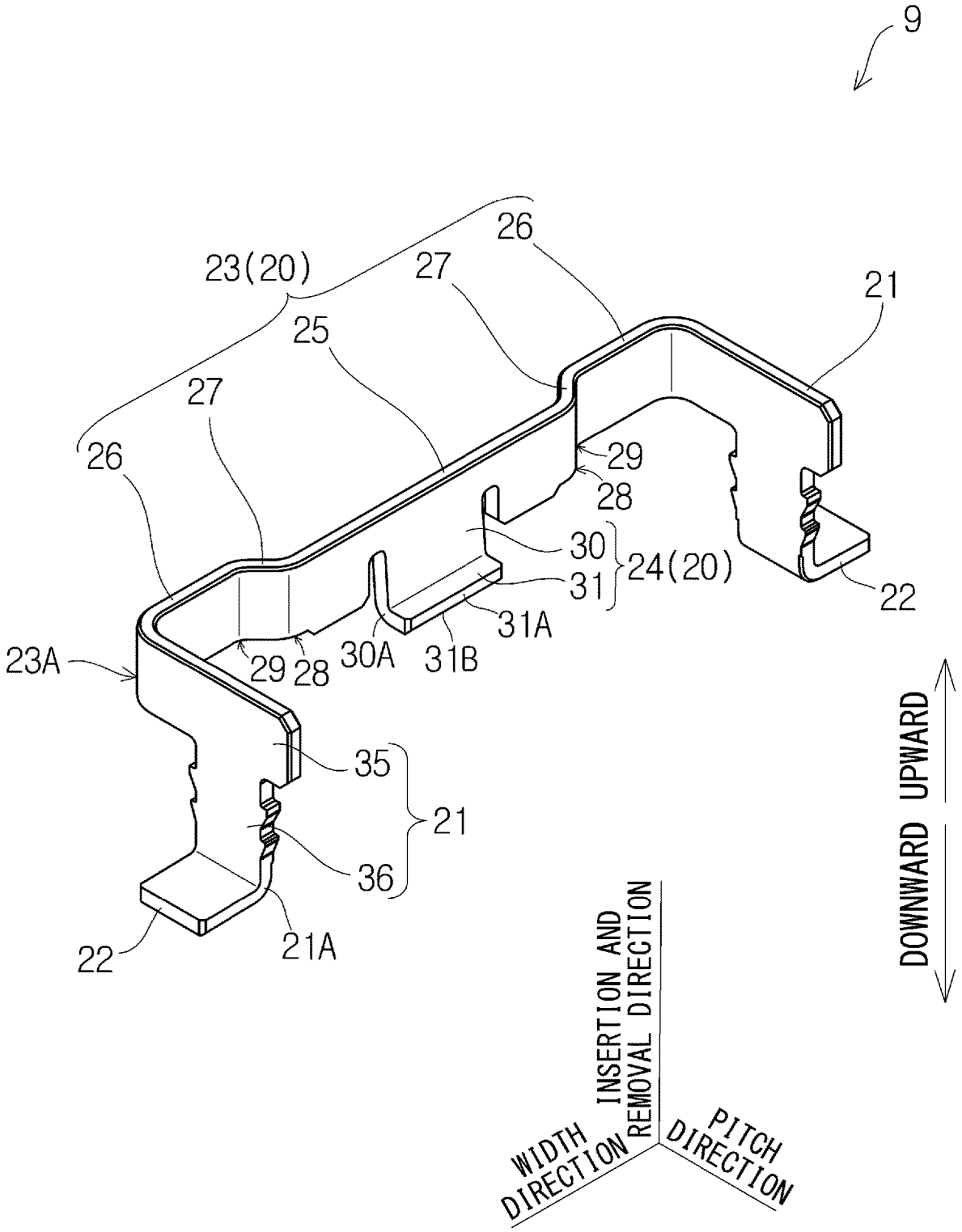
FIG. 4 is a perspective view of a receptacle hold-down.
Figure 5:
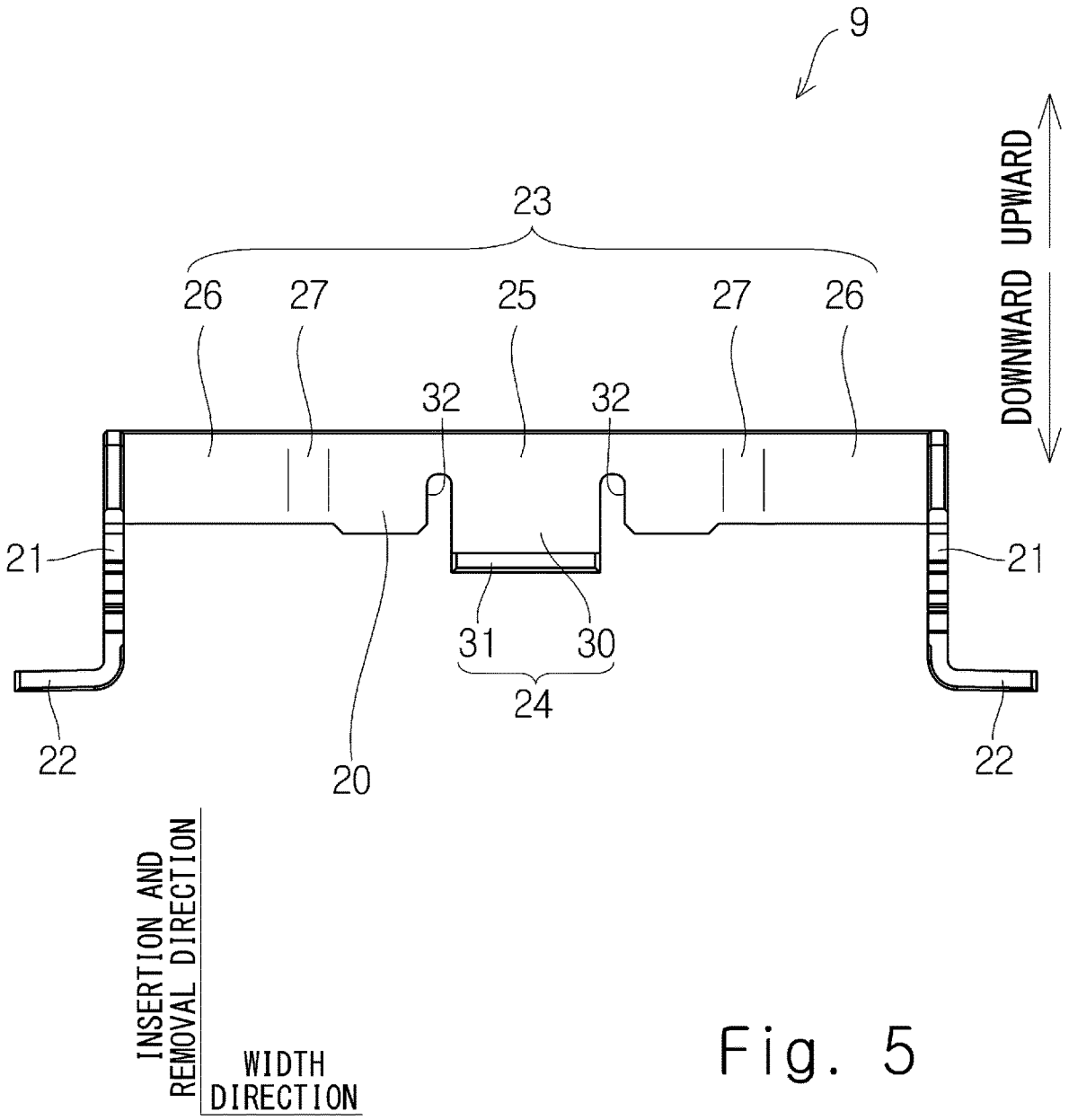
FIG. 5 is a front view of the receptacle hold-down.

FIGS. 4 and 5 show one of the two receptacle hold-downs 9. The two receptacle hold-downs 9 have the same shape, and explanation of the other one is omitted.

In this embodiment, the receptacle hold-down 9 is formed by punching and bending a metal plate made of copper or copper alloy. As shown in FIGS. 4 and 5, the receptacle hold-down 9 is formed symmetrically in the width direction.

As shown in FIG. 4, the receptacle hold-down 9 includes an elastic deformation part 20, two housing fixed parts 21 (fixed parts), and two board fixed parts 22.

The elastic deformation part 20 includes a coupling beam 23 and a contact part 24.

The coupling beam 23 has an elongated shape to connect the two housing fixed parts 21. The coupling beam 23 is supported like a fixed-fixed beam by the two housing fixed parts 21. The coupling beam 23 includes a center beam part 25, two fixed coupling beam parts 26, and two oblique middle parts 27. The center beam part 25 is disposed between the two oblique middle parts 27. The center beam part 25 and the two oblique middle parts 27 are disposed between the two fixed coupling beam parts 26. Thus, one fixed coupling beam part 26, one oblique middle part 27, the center beam part 25, the other oblique middle part 27, and the other fixed coupling beam part 26 are continuously formed in this recited order along the width direction.

The thickness direction of the center beam part 25 and the thickness direction of the fixed coupling beam parts 26 both coincide with the pitch direction. The center beam part 25 is disposed inward in the pitch direction in relation to the two fixed coupling beam parts 26. The two fixed coupling beam parts 26 are disposed at the same positions in the pitch direction. Each of the oblique middle parts 27 connects the center beam part 25 and each of the fixed coupling beam parts 26. Each of the oblique middle parts 27 extends outward in the pitch direction as it goes outward in the width direction. Thus, the two oblique middle parts 27 extend to come closer to each other as they go inward in the pitch direction.

An inner bend 28 (bend) is formed between the center beam part 25 and each of the oblique middle parts 27. With the existence of the inner bend 28, the thickness direction of the center beam part 25 and the thickness direction of each oblique middle part 27 are different from each other. An outer bend 29 (bend) is formed between each of the oblique middle parts 27 and each of the fixed coupling beam parts 26. With the existence of the outer bend 29, the thickness direction of each oblique middle part 27 and the thickness direction of each fixed coupling beam part 26 are different from each other.

The contact part 24 is supported like a cantilever beam by the center beam part 25, and it projects downward from the center beam part 25. To be specific, the contact part 24 has a downward extension spring part 30 and a horizontal projecting part 31. The downward extension spring part 30 is a part that projects downward from the center beam part 25. The horizontal projecting part 31 is a part that projects inward in the pitch direction from a lower end 30A of the downward extension spring part 30. Thus, the contact part 24 is L-shaped when viewed in the width direction. The horizontal projecting part 31 has an end surface 31A facing inward in the pitch direction and a lower surface 31B facing downward. In this embodiment, as shown in FIG. 5, the center beam part 25 has two slits 32 that open downward. The two slits 32 are formed on both sides of the contact part 24 in the width direction. With the existence of the two slits 32, the length of the downward extension spring part 30 of the contact part 24 in the insertion and removal direction is long enough.

Each of the housing fixed parts 21 is a part that fixes the receptacle hold-down 9 to the fixed housing 6, and it includes a fixed part main body 35 and a fixation part 36. The fixed part main body 35 of each housing fixed part 21 is a part that extends inward in the pitch direction from each end 23A of the coupling beam 23 in the width direction. The fixation part 36 is a part to be fixed to the fixed housing 6 by press fitting, and it is a part that projects downward from the fixed part main body 35. Note that the fixation part 36 may be fixed to the fixed housing 6 by bonding, welding, screwing or another means, instead of being fixed to the fixed housing 6 by press fitting.

Each of the board fixed parts 22 is a part to fix the receptacle hold-down 9 to the pattern of the connector mounting surface 3A of the receptacle board 3 by soldering, and it is formed to project outward in the width direction from a lower end 21A of each of the housing fixed parts 21. Note that each of the board fixed parts 22 may be fixed to the connector mounting surface 3A of the receptacle board 3 by bonding, welding, screwing or another means, instead of being fixed to the pattern of the connector mounting surface 3A of the receptacle board 3 by soldering.

Receptacle Connector 5: Movable Housing 7

Figure 6:
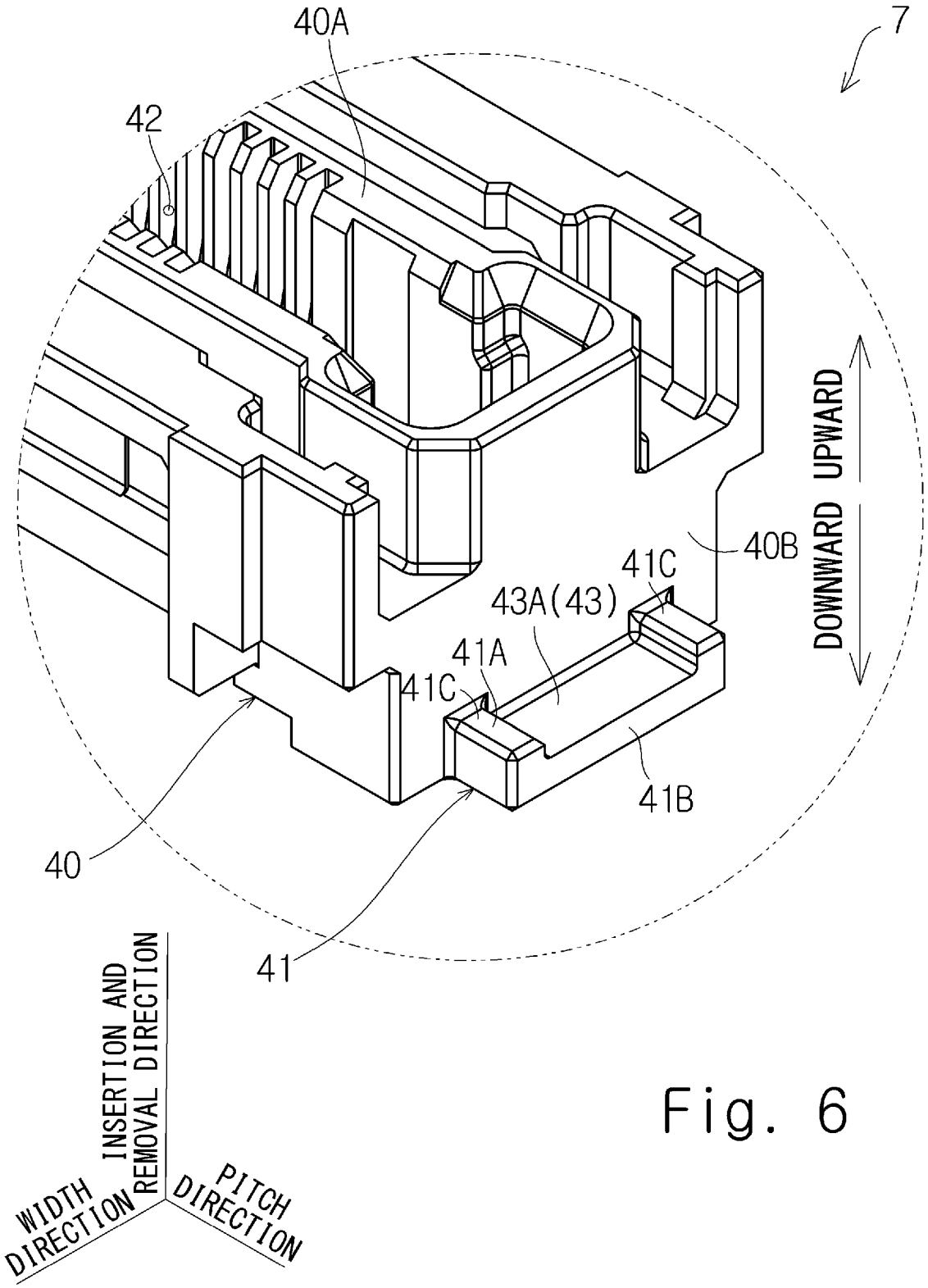
FIG. 6 is a perspective view of a movable housing.

FIG. 6 shows an end part of the movable housing 7 in the pitch direction. The movable housing 7 is made of insulating resin and formed symmetrically in the pitch direction and the width direction, and it includes a movable housing main body 40 and two floating interference parts 41.

The movable housing main body 40 is formed in a rectangular parallelepiped elongated in the pitch direction, and it has an upper surface 40A and two side surfaces 40B facing outward in the pitch direction. The upper surface 40A of the movable housing main body 40 has a mating insertion opening 42 that opens upward and is capable of receiving the plug connector 4.

Each of the floating interference parts 41 is a part that prevents the movable housing 7 from moving upward from the fixed housing 6 in combination with each of the receptacle hold-downs 9, and it projects outward in the pitch direction from each of the side surfaces 40B. Each of the floating interference parts 41 is formed substantially in a rectangular parallelepiped, and it has an upper surface 41A and an end surface 41B facing outward in the pitch direction. The upper surface 41A has a recess 43. Each of the floating interference parts 41 has a bottom surface 43A of the recess 43. The upper surface 41A is divided by the recess 43 in the width direction, and thereby has two upper separate surfaces 41C. The two upper separate surfaces 41C are disposed on both sides of the bottom surface 43A in the width direction when viewed from above. The two upper separate surfaces 41C are disposed upper than the bottom surface 43A. Thus, each of the floating interference parts 41 is in a U-shape that opens upward when viewed in the pitch direction. The end surface 41B is a surface orthogonal to the pitch direction.

Receptacle Connector 5: Fixed Housing 6

As shown in FIG. 3, the fixed housing 6 is made of insulating resin and formed symmetrically in the pitch direction and the width direction, and it includes a flat-plate inner bottom part 50, two contact holding parts 51, and two hold-down holding parts 52. The thickness direction of the inner bottom part 50 is parallel to the insertion and removal direction. The two contact holding parts 51 are opposed to each other on both sides of the inner bottom part 50 in the width direction. The two hold-down holding parts 52 are opposed to each other on both sides of the inner bottom part 50 in the pitch direction. Thus, the two contact holding parts 51 and the two hold-down holding parts 52 are disposed to surround the inner bottom part 50.

Each of the contact holding parts 51 is a part that holds the plurality of receptacle contacts 8.

Figure 7:
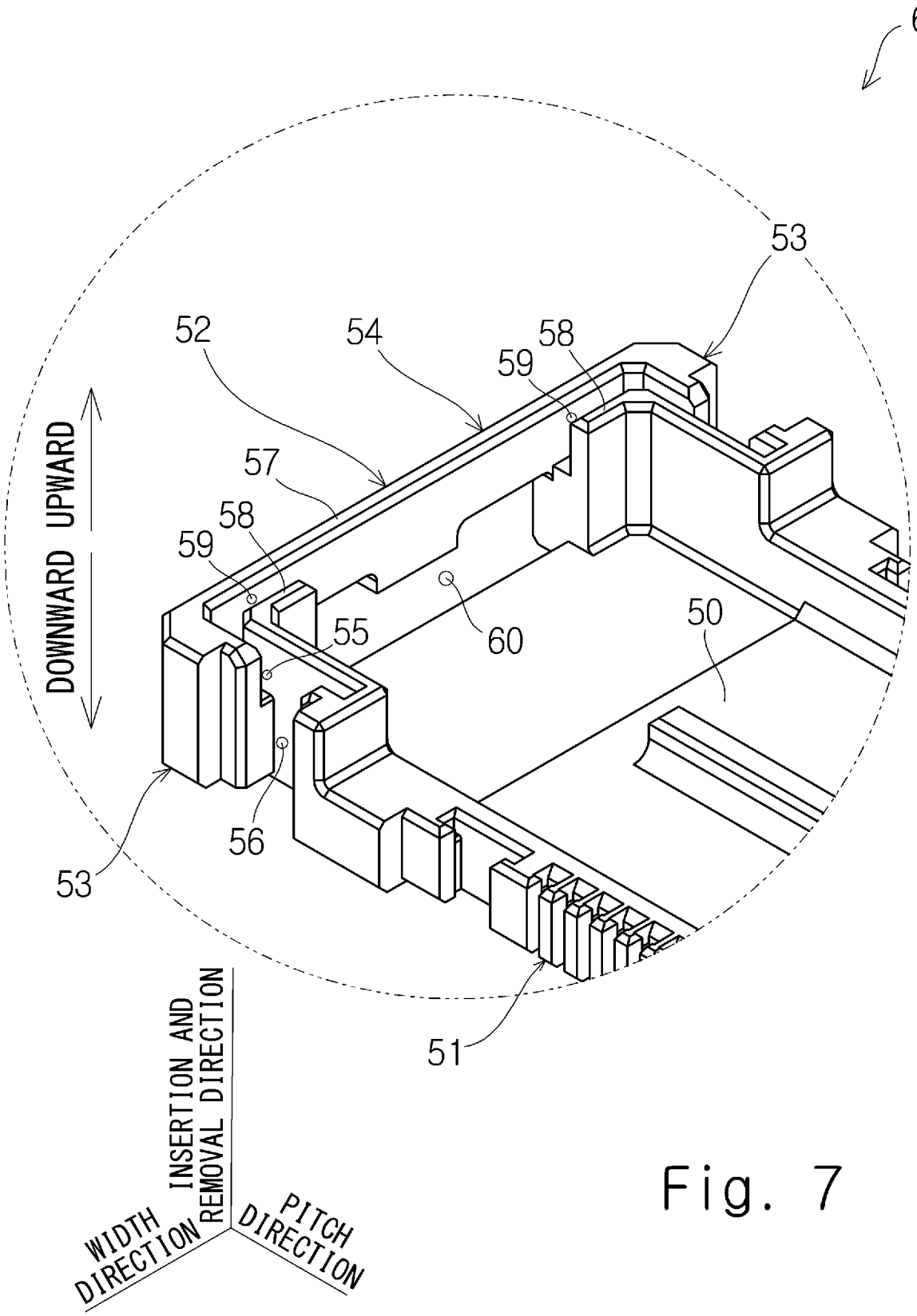
FIG. 7 is a perspective view of a fixed housing.

Each of the hold-down holding parts 52 is a part that holds each of the receptacle hold-downs 9, and it is in a substantially U-shape that opens inward in the pitch direction when viewed from above. Since the fixed housing 6 is symmetrical in the pitch direction, one hold-down hold part 52 is described hereinafter, and the other one is not redundantly described. FIG. 7 shows the hold-down holding part 52 in an enlarged scale. As shown in FIG. 7, the hold-down holding part 52 includes two hold-down hold parts 53 and a hold-down protection part 54.

The two hold-down hold parts 53 are separated from and are opposed to each other along the width direction. Each of the hold-down hold parts 53 has a fixed part main body accommodation groove 55 that opens upward and extends in the pitch direction, and a fixation part accommodation groove 56 that opens outward in the width direction and extends in the insertion and removal direction.

The hold-down protection part 54 includes an outer protection part 57 (outer wall) that extends in the width direction so as to connect the two hold-down hold parts 53, and two inner protection parts 58. The two inner protection parts 58 are disposed inward in the pitch direction in relation to the outer protection part 57, and they are separated from each other in the width direction. Gaps 59 that are able to accommodate the elastic deformation part 20 of the receptacle hold-downs 9 are formed respectively between the two inner protection parts 58 and the outer protection part 57. A lower part of the outer protection part 57 has a through-hole 60 that runs through it in the pitch direction.

Method of Manufacturing Receptacle Connector 5

A method of manufacturing the receptacle connector 5 is described hereinafter. A method of manufacturing each component of the receptacle connector 5 is omitted, and a method of assembling the receptacle connector 5 is described hereinafter.

First, the plurality of receptacle contacts 8 shown in FIG. 3 are press-fit into the corresponding slits of the two contact holding parts 51 of the fixed housing 6.

Next, the plurality of receptacle contacts 8 are press-fit into the corresponding slits of the movable housing main body 40 of the movable housing 7.

The plurality of receptacle contacts 8 are thereby disposed across the fixed housing 6 and the movable housing 7.

Then, the two receptacle hold-downs 9 are respectively held by the two hold-down holding parts 52 of the fixed housing 6. To be specific, the fixed part main body 35 in FIG. 4 is accommodated in the fixed part main body accommodation groove 55 in FIG. 7, and the fixation part 36 in FIG. 4 is press-fit into the fixation part accommodation groove 56 in FIG. 7. Each of the housing fixed parts 21 of each of the receptacle hold-downs 9 is thereby fixed immovably to the fixed housing 6. Although the fixed coupling beam parts 26 in FIG. 4 are respectively inserted into the gaps 59 in FIG. 7, because the size of the gaps 59 in the pitch direction is larger than the thickness direction of the fixed coupling beam parts 26, the fixed coupling beam parts 26 are allowed to be elastically deformed in the pitch direction while being accommodated in the gaps 59. Further, while the center beam part 25 and the two oblique middle parts 27 in FIG. 4 are covered with the outer protection part 57 of the hold-down protection part 54 in FIG. 7 on its outer side in the pitch direction, they are not covered with the hold-down protection part 54 on its inner side in the pitch direction. Further, because the center beam part 25 and the two oblique middle parts 27 in FIG. 4 are disposed inward in the pitch direction in relation to the two fixed coupling beam parts 26, they are disposed apart from the outer protection part 57 of the hold-down protection part 54 in FIG. 7. This allows elastic deformation and elastic displacement of the center beam part 25 and the two oblique middle parts 27 in the pitch direction. Further, while the coupling beam 23 is supported like a fixed-fixed beam by the two housing fixed parts 21, because the coupling beam 23 includes a plurality of bends, i.e., the two inner bends 28 and the two outer bends 29, the coupling beam 23 is easily elastically deformable in the pitch direction compared with the case where the coupling beam 23 is linear in the width direction.

Figure 8:
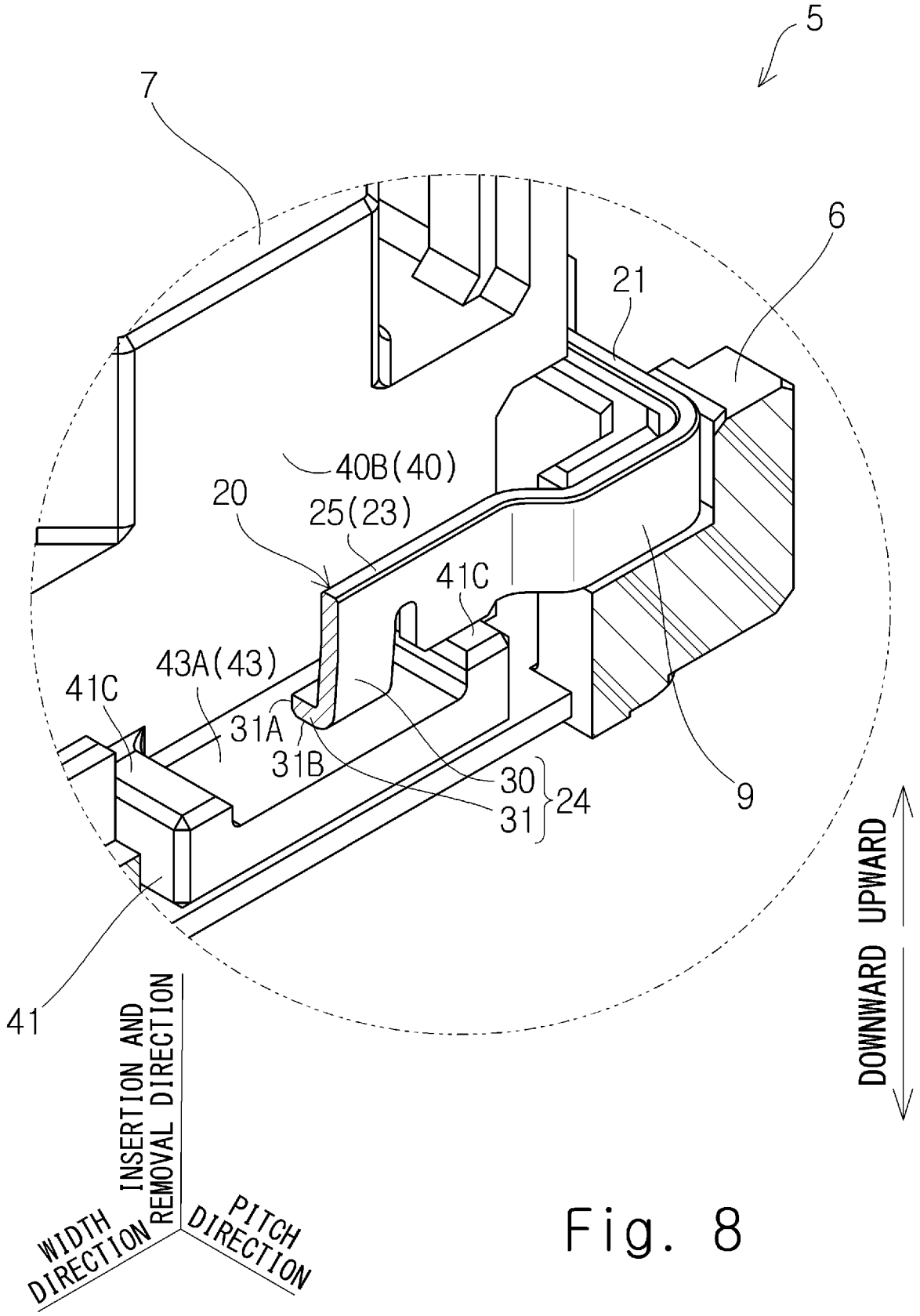
FIG. 8 is a partially cutout perspective view of the receptacle connector.

FIG. 8 shows a perspective view in which the fixed housing 6 and the receptacle hold-downs 9 are partially cutout. As shown in FIG. 8, in the assembled receptacle connector 5, the coupling beam 23 of the elastic deformation part 20 of the receptacle hold-down 9 is disposed upper than the floating interference part 41 of the movable housing 7. The coupling beam 23 is opposed to the floating interference part 41 in the insertion and removal direction. To be specific, the center beam part 25 of the coupling beam 23 is opposed to the upper separate surface 41C of the floating interference part 41 in the insertion and removal direction. Further, the lower surface 31B of the horizontal projecting part 31 of the contact part 24 is opposed to the bottom surface 43A of the recess 43 of the floating interference part 41 in the insertion and removal direction. Thus, when removing the plug connector 4 upward from the receptacle connector 5, even if the movable housing 7 moves upward in relation to the fixed housing 6, the movable housing 7 butts against the receptacle hold-downs 9 in the insertion and removal direction, and further upward movement of the movable housing 7 is thereby restricted. This prevents the plurality of receptacle contacts 8 disposed across the fixed housing 6 and the movable housing 7 from being damaged due to excessive deformation when removing the plug connector 4 from the receptacle connector 5.

Figure 9:
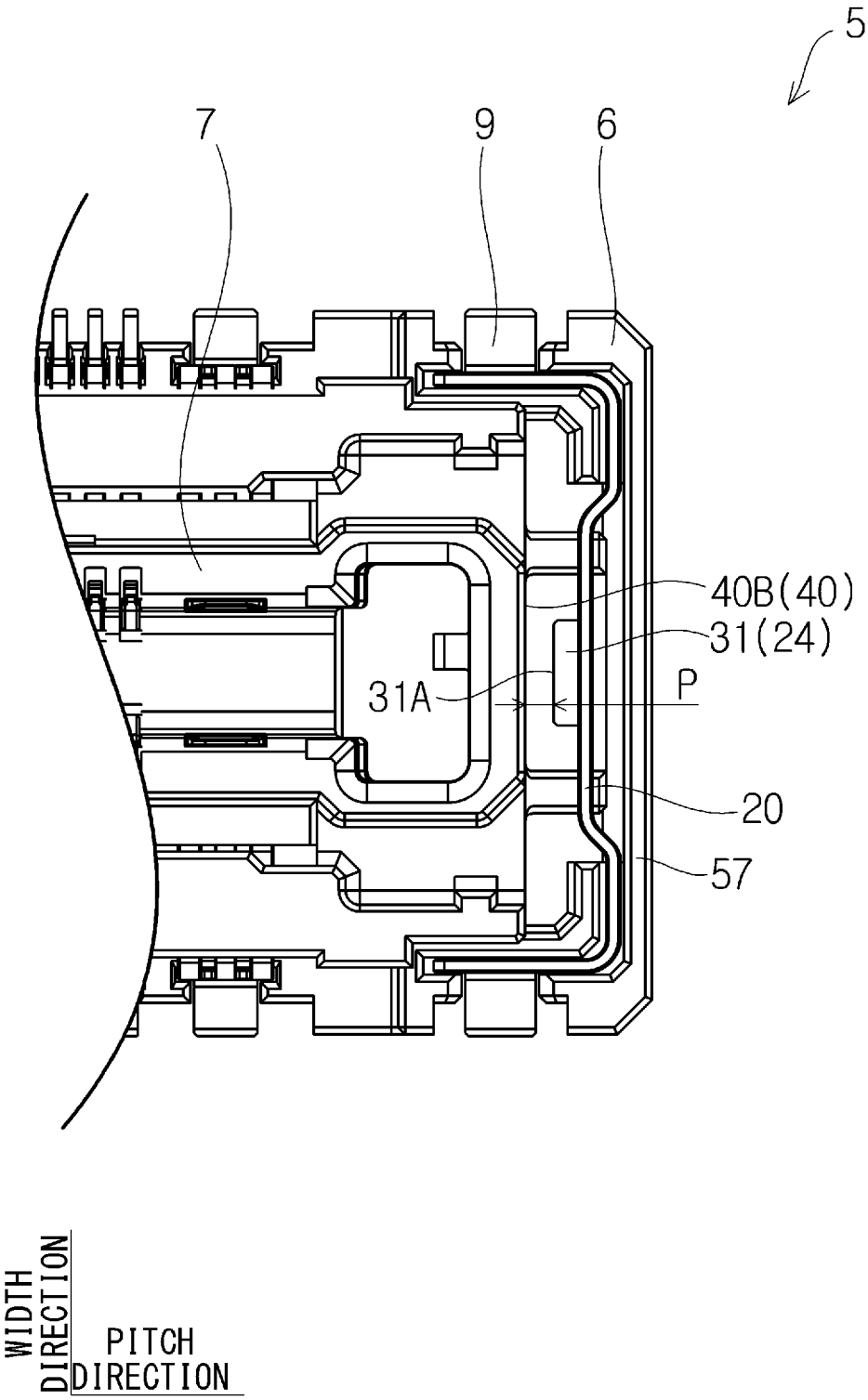
FIG. 9 is an illustration diagram of a floating function of the receptacle connector.

Further, as shown in FIG. 8, in the assembled receptacle connector 5, the contact part 24 of the elastic deformation part 20 of the receptacle hold-downs 9 is disposed outward in the pitch direction in relation to the movable housing main body 40 of the movable housing 7. To be specific, the end surface 31A of the horizontal projecting part 31 of the contact part 24 is opposed to the side surface 40B of the movable housing main body 40 in the pitch direction. As shown in FIG. 9, when the movable housing 7 in a neutral position in the pitch direction relative to the fixed housing 6, the end surface 31A and the side surface 40B are separated by a predetermined distance P from each other in the pitch direction. Thus, as shown in FIG. 10, when the movable housing 7 moves in relation to the fixed housing 6 by the predetermined distance P in the pitch direction, the side surface 40B comes into contact with the end surface 31A.

Figure 11:
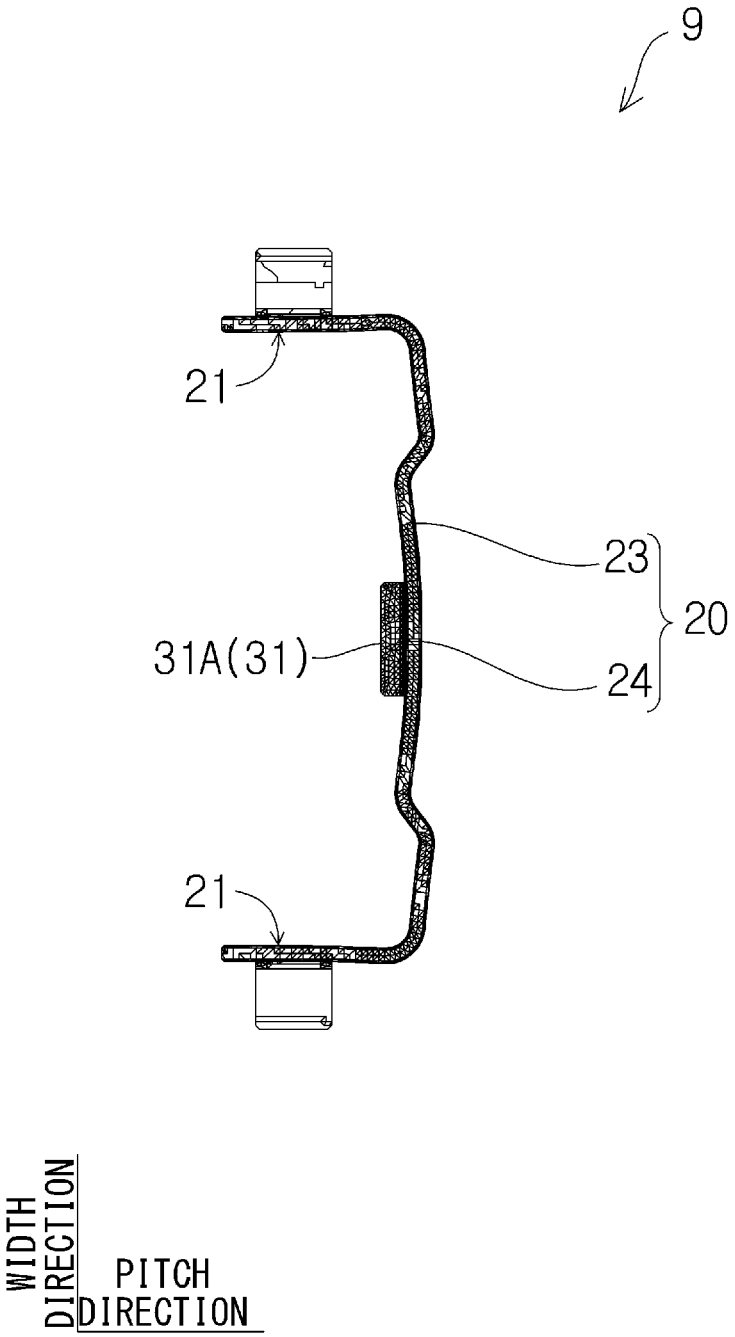
FIG. 11 is a plan view of the elastically deformed receptacle hold-down.

FIG. 11 shows a result of numerical analysis using a three-dimensional finite-element method of elastic deformation of the receptacle hold-downs 9 when an external force is applied outward in the pitch direction to the end surface 31A of the horizontal projecting part 31 of the elastic deformation part 20 of the receptacle hold-downs 9. The boundary condition used in this numerical analysis is that the two housing fixed parts 21 are not displaced. As shown in FIG. 11, the elastic deformation part 20 is elastically deformable in the pitch direction. Specifically, the end surface 31A of the horizontal projecting part 31 of the contact part 24 is elastically displaceable outward in the pitch direction.

Figure 10:
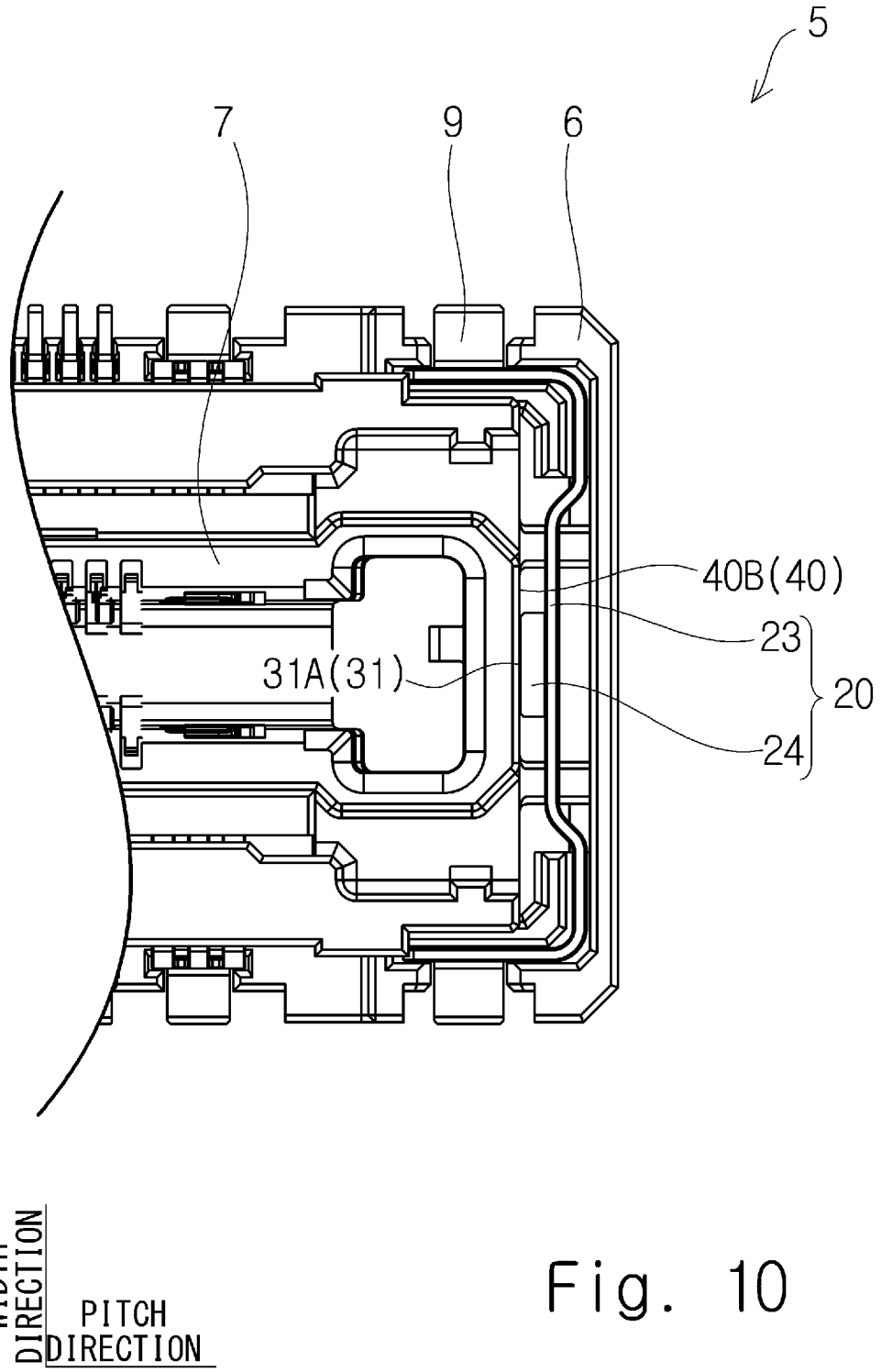
FIG. 10 is an illustration diagram of a floating function of the receptacle connector.

Thus, from the state where the side surface 40B is in contact with the end surface 31A as shown in FIG. 10, the movable housing 7 is able to move in the pitch direction in relation to the fixed housing 6, with the elastic deformation part 20 being elastically deformed in the pitch direction. Since the elastic deformation part 20 is elastically deformable in the pitch direction, the movable housing 7 is movable by a distance larger than the predetermined distance P in the pitch direction in relation to the fixed housing 6. Thus, even when the gap between the movable housing 7 and the elastic deformation part 20 in the pitch direction, which is the predetermined distance P, is set small, floating over a distance larger than this gap is achieved by elastic deformation of the elastic deformation part 20. It is thereby possible to both achieve a desired amount of floating in the pitch direction and downsize the receptacle connector 5 in the pitch direction.

The first embodiment is described above. The above-described embodiment has the following features.

As shown in FIGS. 1 to 3, the receptacle connector 5 (floating connector) includes the fixed housing 6, the movable housing 7, the plurality of receptacle contacts 8 (contacts) disposed across the fixed housing 6 and the movable housing 7, and the receptacle hold-downs 9 (movement restriction members) that restrict the upward movement (in the removal direction) of the movable housing 7 from the fixed housing 6. The movable housing 7 is movable in the pitch direction of the plurality of receptacle contacts 8 in relation to the fixed housing 6. As shown in FIG. 4, the receptacle hold-down 9 includes the two housing fixed parts 21 (fixed parts) to be fixed to the fixed housing 6, and the elastic deformation part 20 supported by the housing fixed parts 21 and opposed to the movable housing 7 in the insertion and removal direction. As shown in FIGS. 8 to 11, the elastic deformation part 20 is opposed to the movable housing 7 in the pitch direction and elastically deformable in the pitch direction. In this structure, even when the gap between the movable housing 7 and the elastic deformation part 20 in the pitch direction is set small, floating over a distance larger than this gap is achieved by elastic deformation of the elastic deformation part 20. It is thereby possible to achieve both a desired amount of floating in the pitch direction and downsizing of the receptacle connector 5 in the pitch direction.

Although the receptacle connector 5 includes two receptacle hold-downs 9 in this embodiment, the receptacle connector 5 may include only one receptacle hold-down 9. Further, although the receptacle hold-down 9 includes two housing fixed parts 21 in this embodiment, the receptacle hold-down 9 may include only one housing fixed part 21.

Further, as shown in FIG. 4, the elastic deformation part 20 includes the coupling beam 23 that connects the two housing fixed parts 21. The coupling beam 23 includes a plurality of bends, i.e., the two inner bends 28 and the two outer bends 29. In this structure, the coupling beam 23 is easily elastically deformable in the pitch direction, and it is thereby possible to both achieve a desired amount of floating in the pitch direction and downsize the receptacle connector 5 in the pitch direction more effectively.

Although the coupling beam 23 has a plurality of bends in this embodiment, the coupling beam 23 may have only one bend. Further, the coupling beam 23 may have at least one curve instead of a bend. In this case also, the coupling beam 23 is easily elastically deformable in the pitch direction, and it is thereby possible to both achieve a desired amount of floating in the pitch direction and downsize the receptacle connector 5 in the pitch direction more effectively.

Further, as shown in FIG. 4, the bends, i.e., the two inner bends 28 and the two outer bends 29, of the coupling beam 23 bend the coupling beam 23 so as to vary the thickness direction of the coupling beam 23. In the case where the coupling beam 23 has a curve instead of a bend, the curve preferably curves the coupling beam 23 so as to vary the thickness direction of the coupling beam 23.

Further, as shown in FIG. 8, the elastic deformation part 20 includes the coupling beam 23 that connects the two housing fixed parts 21, and the contact part 24 that is supported by the coupling beam 23 and is capable of coming into contact with the movable housing 7 in the pitch direction. The contact part 24 is disposed in such a way that movement of the contact part 24 in the pitch direction causes twist deformation of the coupling beam 23. To be specific, because the contact part 24 is supported like a cantilever beam by the coupling beam 23, when the contact part 24 moves in the pitch direction, moment occurs in the contact part 24, this causes twist deformation of the coupling beam 23. In this structure, the coupling beam 23 is twist-deformed, and it is thereby possible to both achieve a desired amount of floating in the pitch direction and downsize the receptacle connector 5 in the pitch direction more effectively.

Further, as shown in FIG. 8, the thickness direction of the housing fixed parts 21 is the direction orthogonal to the pitch direction. In other words, the thickness direction of the housing fixed parts 21 coincides with the width direction. In this structure, the coupling beam 23 is longer compared with the case where the thickness direction of the housing fixed parts 21 coincides with the pitch direction, and the coupling beam 23 is more easily elastically deformable.

Further, as shown in FIG. 4, the elastic deformation part 20 includes the coupling beam 23 that connects the two housing fixed parts 21, and the contact part 24 that is supported by the coupling beam 23 and is capable of coming into contact with the movable housing 7 in the pitch direction. The contact part 24 is supported like a cantilever beam by the coupling beam 23. In this structure, the contact part 24 is easily deformable in the pitch direction, and it is thereby possible to both achieve a desired amount of floating in the pitch direction and downsize the receptacle connector 5 in the pitch direction more effectively.

Further, as shown in FIG. 9, the receptacle connector 5 has the outer protection part 57 (outer wall) that is disposed across the elastic deformation part 20 from the movable housing 7 in the pitch direction, and covers the elastic deformation part 20. In this structure, the elastic deformation part 20 is less exposed to the outside, and it is thereby possible to prevent the unintended conduction of the elastic deformation part 20 with another part.

Second Embodiment

A second embodiment is described hereinafter with reference to FIG. 12. Hereinafter, differences of this embodiment from the first embodiment are mainly described, and redundant description is omitted.

For example, as shown in FIG. 4, the coupling beam 23 has the two inner bends 28 and the two outer bends 29, so that the coupling beam 23 is easily elastically deformable in the pitch direction in the above-described first embodiment.

Figure 12:
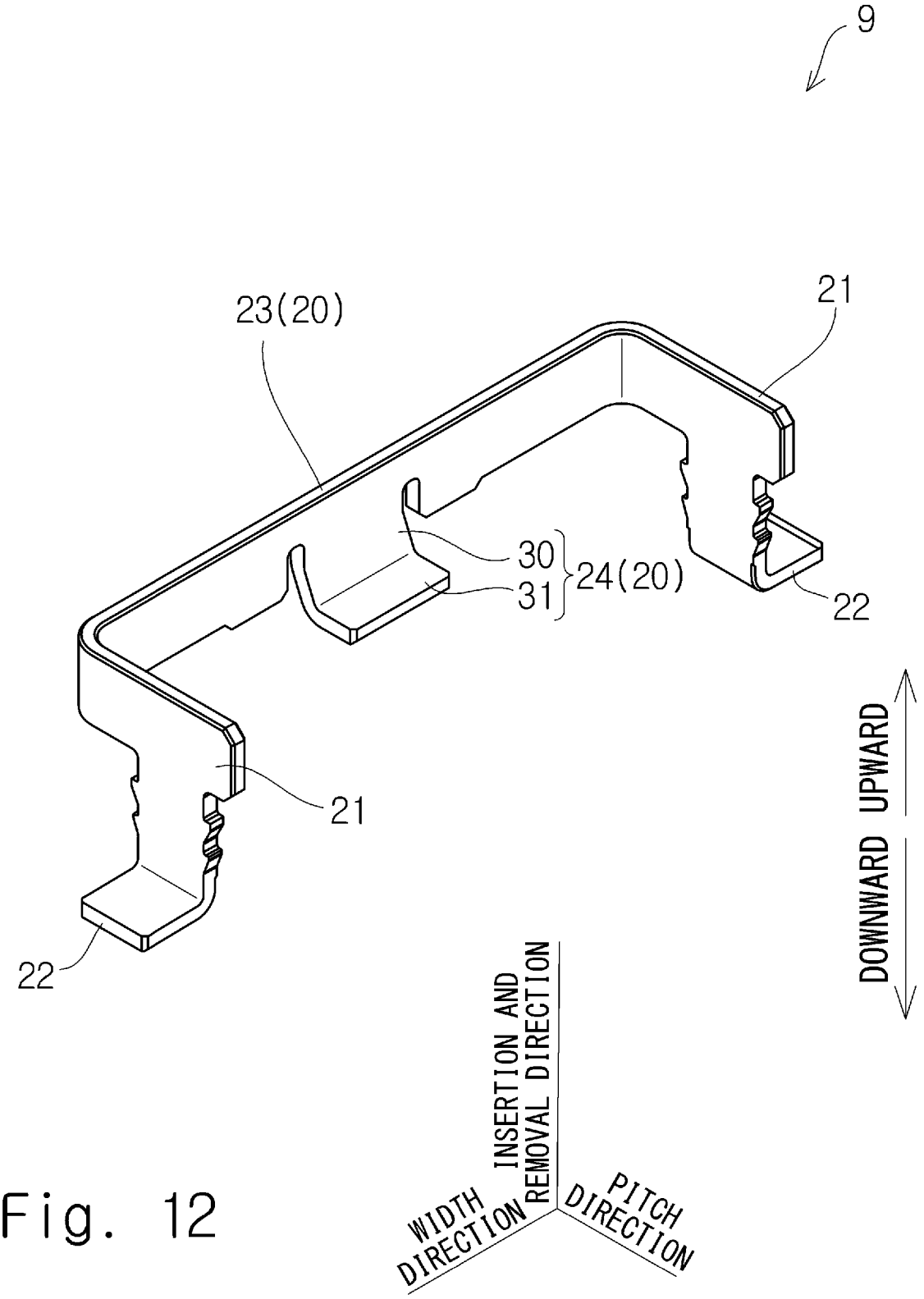
FIG. 12 is a perspective view of a receptacle hold-down (second embodiment)

Alternatively, in this embodiment, the coupling beam 23 is linear in the width direction as shown in FIG. 12. In this case also, because the contact part 24 is supported like a cantilever beam by the coupling beam 23, the contact part 24 is easily elastically deformable outward in the pitch direction, and it is thereby possible to both achieve the amount of floating in the pitch direction and downsize the receptacle connector 5 in the pitch direction.

Further, because the contact part 24 is supported like a cantilever beam by the coupling beam 23, when the contact part 24 moves in the pitch direction, moment occurs in the contact part 24, which causes twist deformation of the coupling beam 23. In this structure, the coupling beam 23 is twist-deformed, and it is thereby possible to both achieve a desired amount of floating in the pitch direction and downsize the receptacle connector 5 in the pitch direction more effectively.

Third Embodiment

A third embodiment is described hereinafter with reference to FIGS. 13 and 14. Hereinafter, differences of this embodiment from the first embodiment are mainly described, and redundant description is omitted.

This embodiment is different from the above-described first embodiment in the shape of the contact part 24.

Figure 13:
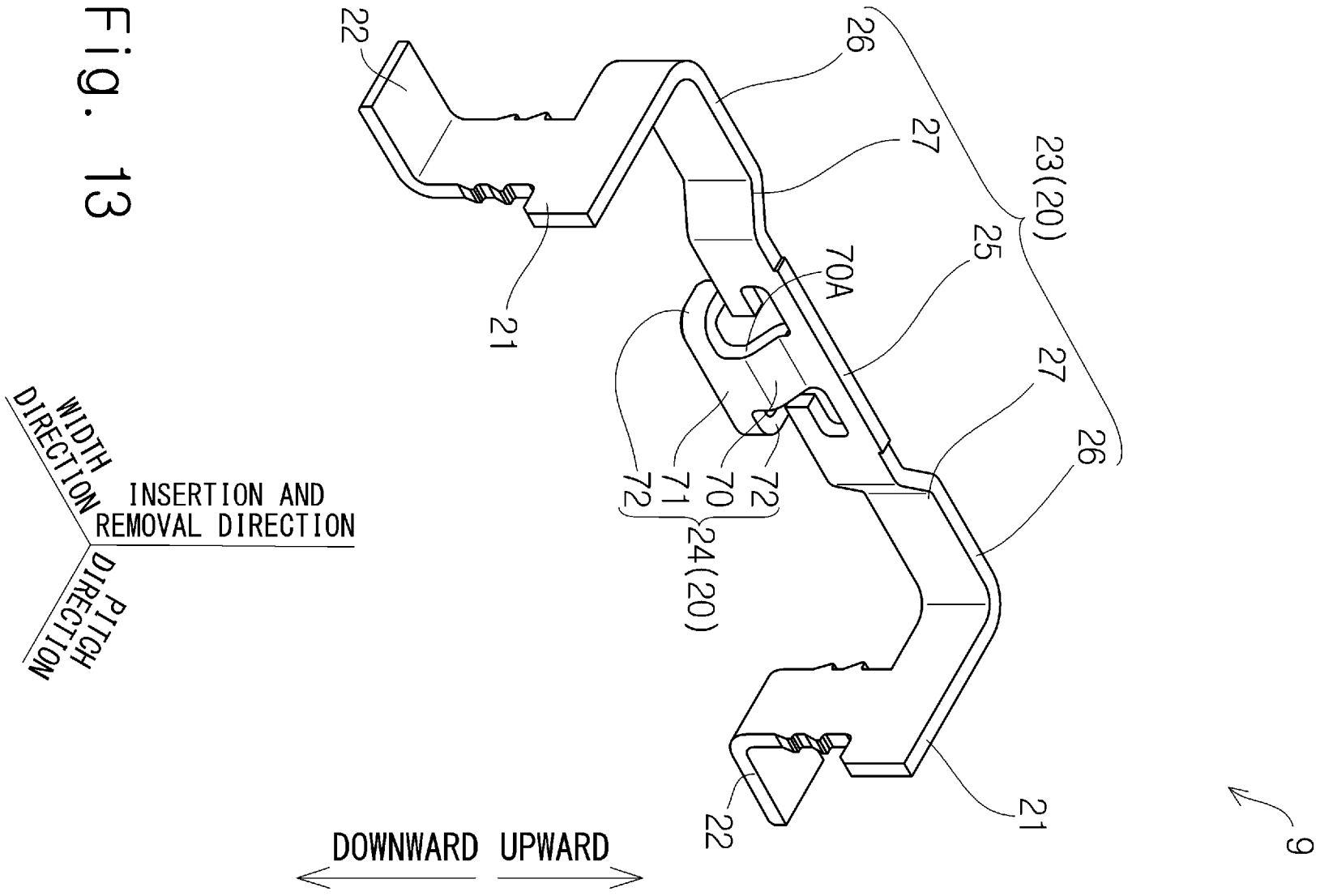
FIG. 13 is a perspective view of a receptacle hold-down (third embodiment)

Specifically, as shown in FIG. 13, the contact part 24 in this embodiment is supported like a cantilever beam by the center beam part 25, and it projects downward from the center beam part 25. To be specific, the contact part 24 has a tilted spring part 70, a vertical projecting part 71, and two L-shaped projecting parts 72.

The tilted spring part 70 is a part that projects downward from the center beam part 25. To be specific, the tilted spring part 70 extends inward in the pitch direction as it goes downward. The vertical projecting part 71 is a part that projects downward from a lower end 70A of the tilted spring part 70. The thickness direction of the vertical projecting part 71 coincides with the pitch direction. The two L-shaped projecting parts 72 are formed in an L-shape when viewed from above, which respectively project outward in the width direction from both ends of the vertical projecting part 71 in the width direction and then project outward in the pitch direction.

Figure 14:
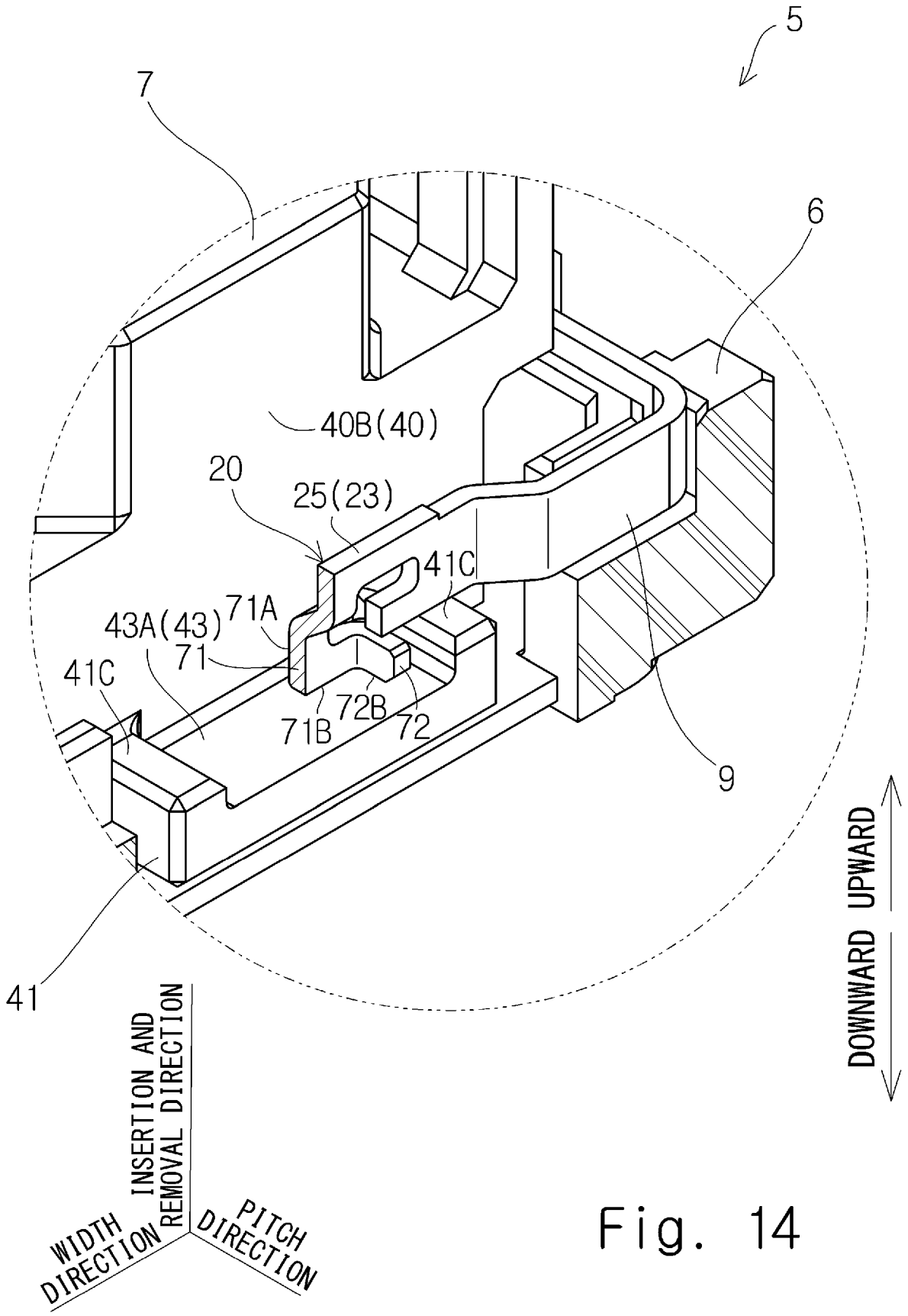
FIG. 14 is a partially cutout perspective view of a receptacle connector (third embodiment)

FIG. 14 shows a perspective view in which the fixed housing 6 and the receptacle hold-downs 9 are partially cutout. As shown in FIG. 14, in the assembled receptacle connector 5, the coupling beam 23 of the elastic deformation part 20 of the receptacle hold-down 9 is disposed above the floating interference part 41 of the movable housing 7. The coupling beam 23 is opposed to the floating interference part 41 in the insertion and removal direction. To be specific, the center beam part 25 of the coupling beam 23 is opposed to the two upper separate surfaces 41C of the floating interference parts 41 in the insertion and removal direction. Further, a lower surface 71B of the vertical projecting part 71 of the contact part 24 and lower surfaces 72B of the two L-shaped projecting parts 72 of the contact part 24 are opposed to the bottom surface 43A of the recess 43 of the floating interference parts 41 in the insertion and removal direction. Thus, when removing the plug connector 4 upward from the receptacle connector 5, even if the movable housing 7 moves upward in relation to the fixed housing 6, the movable housing 7 butts against the receptacle hold-downs 9 in the insertion and removal direction, and further upward movement of the movable housing 7 is thereby restricted. This prevents the plurality of receptacle contacts 8 disposed across the fixed housing 6 and the movable housing 7 from being damaged due to excessive deformation when removing the plug connector 4 from the receptacle connector 5.

Further, as shown in FIG. 14, in the assembled receptacle connector 5, the contact part 24 of the elastic deformation part 20 of the receptacle hold-downs 9 is disposed outward in the pitch direction in relation to the movable housing main body 40 of the movable housing 7. To be specific, a side surface 71A of the vertical projecting part 71 of the contact part 24 is opposed to the side surface 40B of the movable housing main body 40 in the pitch direction. When the movable housing 7 in a neutral position in the pitch direction relative to the fixed housing 6, the side surface 71A and the side surface 40B are separated by a predetermined distance from each other in the pitch direction. Since the elastic deformation part 20 is elastically deformable in the pitch direction, the movable housing 7 is movable by a distance larger than the predetermined distance in the pitch direction in relation to the fixed housing 6, just like in the first embodiment. Thus, even when the gap between the movable housing 7 and the elastic deformation part 20 in the pitch direction, which is the predetermined distance described above, is set small, floating over a distance larger than this gap is achieved by elastic deformation of the elastic deformation part 20. It is thereby possible to both achieve a desired amount of floating in the pitch direction and downsize the receptacle connector 5 in the pitch direction more effectively.

Fourth Embodiment

A fourth embodiment is described hereinafter with reference to FIG. 15. Hereinafter, differences of this embodiment from the first embodiment are mainly described, and redundant description is omitted.

For example, in the above-described first embodiment, the elastic deformation part 20 includes the coupling beam 23 that is supported like a fixed-fixed beam by the two housing fixed parts 21, and the contact part 24 that is supported like a cantilever beam by the coupling beam 23 as shown in FIG. 4.

Figure 15:
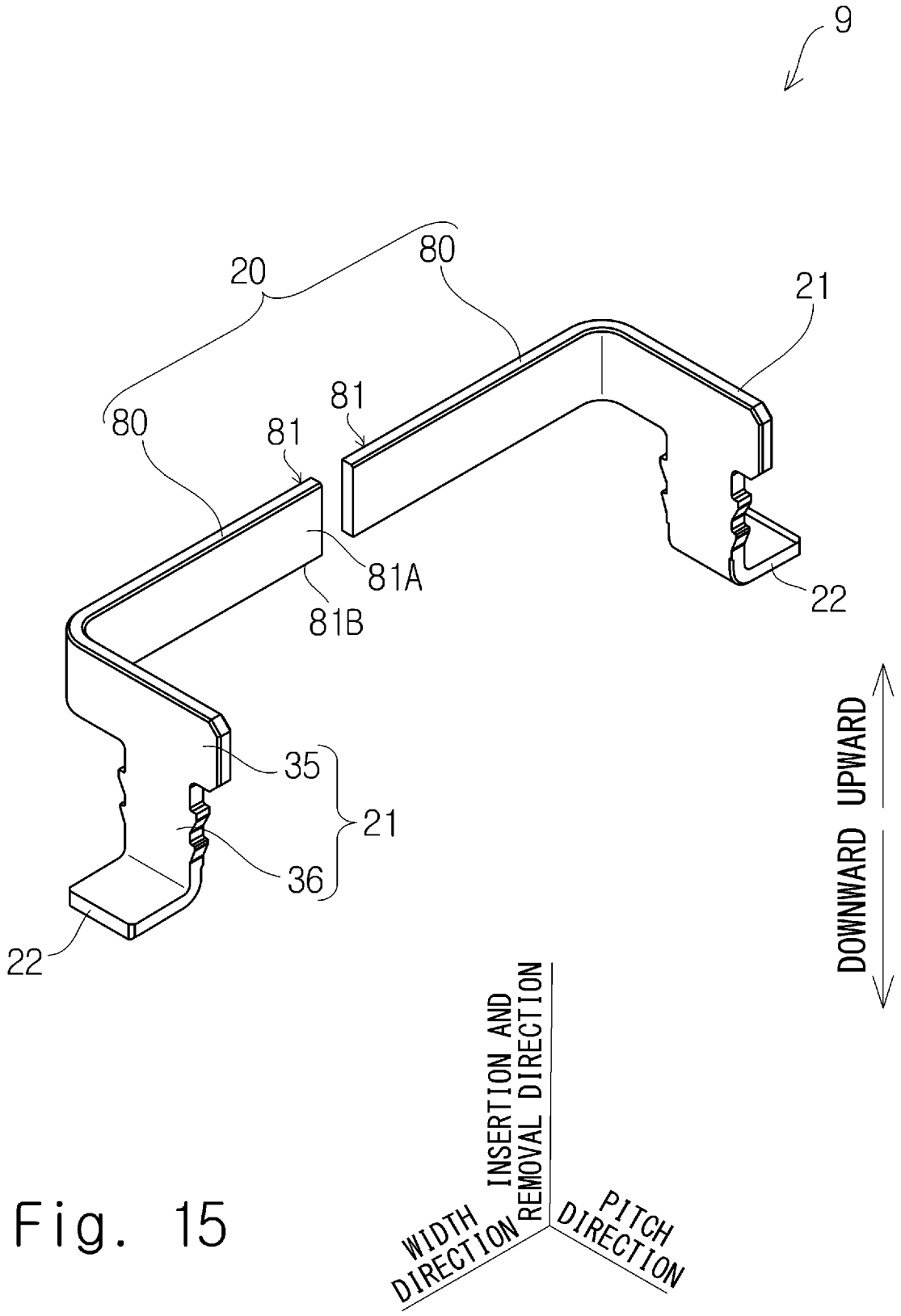
FIG. 15 is a perspective view of a receptacle hold-down (fourth embodiment)
Figure 16:
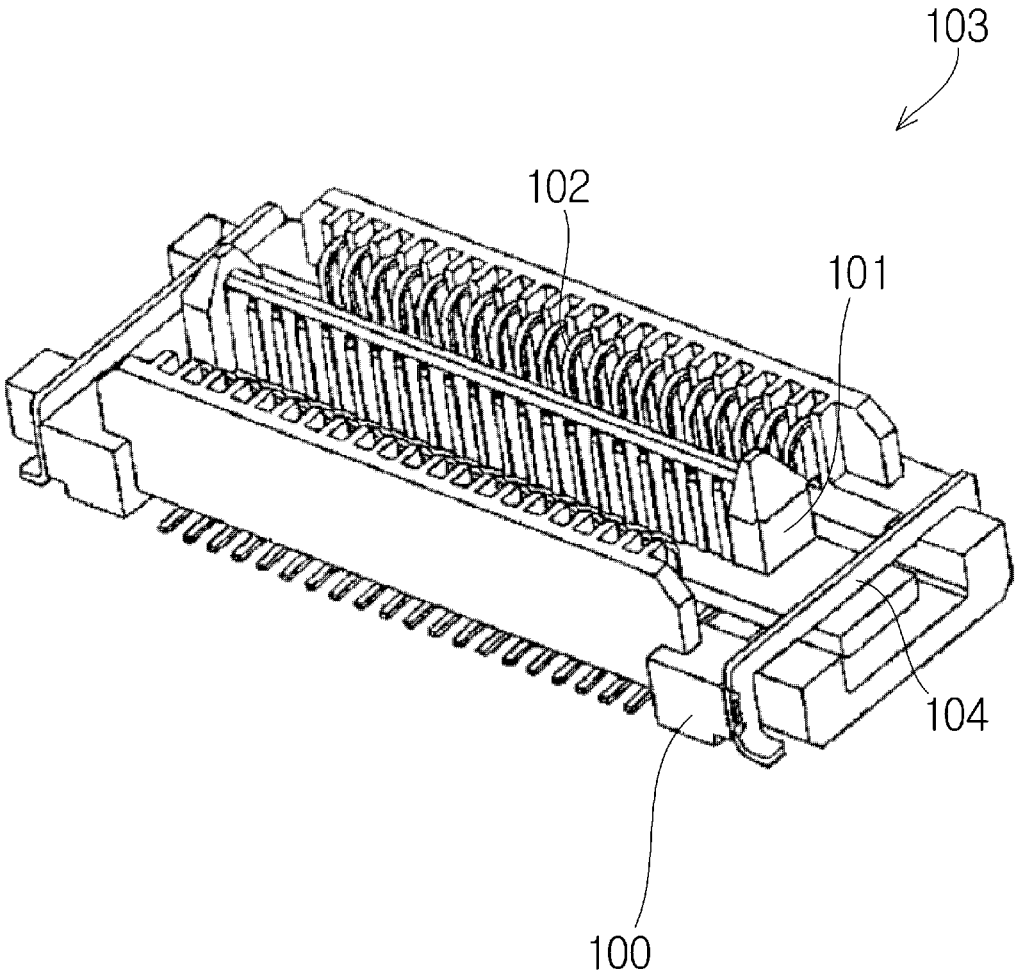
FIG. 16 is a view showing a simplified version of FIG. 1 (A) of Japanese Unexamined Patent Application Publication No. 2007-18785.

On the other hand, in this embodiment, the elastic deformation part 20 is formed in a cantilever beam as shown in FIG. 15. Specifically, the elastic deformation part 20 has two anti-removal beams 80, and each of the anti-removal beams 80 is supported like a cantilever beam by each of the housing fixed parts 21. Each of the anti-removal beams 80 extends linearly inward in the width direction from each of the housing fixed parts 21.

A contact part 81 is formed at a free end of each of the anti-removal beams 80. The contact part 81 has a side surface 81A facing inward in the pitch direction and a lower surface 81B facing downward. The side surface 81A is opposed to the side surface 40B of the movable housing main body 40 of the movable housing 7 in the pitch direction. The lower surface 81B is opposed to the upper surface 41A of the floating interference parts 41 of the movable housing 7 in the insertion and removal direction.

Since the lower surface 81B is opposed to the upper surface 41A in the insertion and removal direction, when removing the plug connector 4 upward from the receptacle connector 5, even if the movable housing 7 moves upward in relation to the fixed housing 6, the movable housing 7 butts against the receptacle hold-downs 9 in the insertion and removal direction, and further upward movement of the movable housing 7 is thereby restricted. This prevents the plurality of receptacle contacts 8 disposed across the fixed housing 6 and the movable housing 7 from being damaged due to excessive deformation when removing the plug connector 4 from the receptacle connector 5.

Further, when the movable housing 7 in a neutral position in the pitch direction relative to the fixed housing 6, the side surface 81A and the side surface 40B are separated by a predetermined distance from each other in the pitch direction. Since the elastic deformation part 20 is elastically deformable in the pitch direction, the movable housing 7 is movable by a distance larger than the predetermined distance in the pitch direction in relation to the fixed housing 6. Thus, even when the gap between the movable housing 7 and the elastic deformation part 20 in the pitch direction, which is the predetermined distance described above, is set small, floating over a distance larger than this gap is achieved by elastic deformation of the elastic deformation part 20. It is thereby possible to both achieve a desired amount of floating in the pitch direction and downsize the receptacle connector 5 in the pitch direction more effectively.

In this embodiment, because the elastic deformation part 20 is supported like a cantilever beam by the housing fixed part 21, the elastic deformation part 20 is more easily elastically deformable in the pitch direction, and it is thereby possible to both achieve a desired amount of floating in the pitch direction and downsize the receptacle connector 5 in the pitch direction more effectively.

Although embodiments of the present disclosure are described above, the first to fourth embodiments can be combined as appropriate.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A floating connector comprising:

a fixed housing;

a movable housing;

a plurality of contacts disposed across the fixed housing and the movable housing; and a movement restriction member that restricts movement of the movable housing in a removal direction from the fixed housing, wherein the movable housing is movable in a pitch direction of the plurality of contacts in relation to the fixed housing, the movement restriction member includes at least one fixed part to be fixed to the fixed housing, and an elastic deformation part supported by the at least one fixed part and opposed to the movable housing in a direction parallel to the removal direction, and the elastic deformation part is opposed to the movable housing in the pitch direction and elastically deformable in the pitch direction, wherein the movable housing is movable in the pitch direction in relation to the fixed housing between a first position at which the movable housing is in contact with the elastic deformation part and the elastic deformation part is not elastically deformed and a second position at which the movable housing is in contact with the elastic deformation part and outward from the first position in the pitch direction and the elastic deformation part is elastically deformed in the pitch direction.

2. The floating connector according to claim 1, wherein the at least one fixed part include two fixed parts, the elastic deformation part includes a coupling beam connecting the two fixed parts, and the coupling beam has at least one bend or curve.

3. The floating connector according to claim 2, wherein the at least one bend or curve bends or curves the coupling beam so as to vary a thickness direction of the coupling beam.

4. A floating connector comprising:

a fixed housing;

a movable housing;

a plurality of contacts disposed across the fixed housing and the movable housing; and a movement restriction member that restricts movement of the movable housing in a removal direction from the fixed housing, wherein the movable housing is movable in a pitch direction of the plurality of contacts in relation to the fixed housing, the movement restriction member includes at least one fixed part to be fixed to the fixed housing, and an elastic deformation part supported by the at least one fixed part and opposed to the movable housing in a direction parallel to the removal direction, and the elastic deformation part is opposed to the movable housing in the pitch direction and elastically deformable in the pitch direction, the at least one fixed part include two fixed parts, the elastic deformation part includes a coupling beam connecting the two fixed parts, and a contact part supported by the coupling beam and capable of coming into contact with the movable housing in the pitch direction, and the contact part is disposed in such a way that movement of the contact part in the pitch direction causes twist deformation of the coupling beam.

5. The floating connector according to claim 2, wherein a thickness direction of the at least one fixed part is orthogonal to the pitch direction.

6. A floating connector comprising:

a fixed housing;

a movable housing;

a plurality of contacts disposed across the fixed housing and the movable housing; and a movement restriction member that restricts movement of the movable housing in a removal direction from the fixed housing, wherein the movable housing is movable in a pitch direction of the plurality of contacts in relation to the fixed housing, the movement restriction member includes at least one fixed part to be fixed to the fixed housing, and an elastic deformation part supported by the at least one fixed part and opposed to the movable housing in a direction parallel to the removal direction, and the elastic deformation part is opposed to the movable housing in the pitch direction and elastically deformable in the pitch direction, the at least one fixed part include two fixed parts, the elastic deformation part includes a coupling beam connecting the two fixed parts, and a contact part supported by the coupling beam and capable of coming into contact with the movable housing in the pitch direction, and the contact part is supported like a cantilever beam by the coupling beam.

7. A floating connector comprising:

a fixed housing;

a movable housing;

a plurality of contacts disposed across the fixed housing and the movable housing; and a movement restriction member that restricts movement of the movable housing in a removal direction from the fixed housing, wherein the movable housing is movable in a pitch direction of the plurality of contacts in relation to the fixed housing, the movement restriction member includes at least one fixed part to be fixed to the fixed housing, and an elastic deformation part supported by the at least one fixed part and opposed to the movable housing in a direction parallel to the removal direction, and the elastic deformation part is opposed to the movable housing in the pitch direction and elastically deformable in the pitch direction, wherein the elastic deformation part is supported like a cantilever beam by the at least one fixed part.

8. The floating connector according to claim 1, wherein the fixed housing comprises an outer wall disposed across the elastic deformation part from the movable housing and covering the elastic deformation part.

* * * * *